US010174566B2

(12) United States Patent
Kubichek et al.

(10) Patent No.: US 10,174,566 B2
(45) Date of Patent: Jan. 8, 2019

(54) INVERTED PULL-UP RISER TENSIONER

(71) Applicant: Vetco Gray Inc., Houston, TX (US)

(72) Inventors: Benjamin James Kubichek, Houston, TX (US); Joseph William Pallini, Houston, TX (US); Jesse B. Riha, Houston, TX (US); Daniel Louis Havelka, Houston, TX (US); Robert James Wagner, Houston, TX (US)

(73) Assignee: Vetco Gray, LLC, Houston, TX (US)

( * ) Notice: Subject to any disclaimer, the term of this patent is extended or adjusted under 35 U.S.C. 154(b) by 0 days.

(21) Appl. No.: 15/434,986

(22) Filed: Feb. 16, 2017

(65) Prior Publication Data

US 2017/0254159 A1 Sep. 7, 2017

Related U.S. Application Data

(60) Provisional application No. 62/302,549, filed on Mar. 2, 2016.

(51) Int. Cl.

| | |
|---|---|
| ***E21B 19/00*** | (2006.01) |
| ***F15B 15/14*** | (2006.01) |
| ***F15B 15/16*** | (2006.01) |

(52) U.S. Cl.

CPC ..... *E21B 19/006* (2013.01); *E21B 19/002* (2013.01); *F15B 15/1428* (2013.01); (Continued)

(58) Field of Classification Search

CPC .... E21B 19/006; E21B 19/09; F15B 15/1428; F15B 15/1447; F15B 15/1461; F15B 15/16

See application file for complete search history.

(56) References Cited

U.S. PATENT DOCUMENTS

| | | |
|---|---|---|
| 4,379,657 A | 4/1983 | Widiner et al. |
| 4,432,420 A | 2/1984 | Gregory et al. |

(Continued)

FOREIGN PATENT DOCUMENTS

| | | |
|---|---|---|
| EP | 0088608 A2 | 9/1983 |
| GB | 2109036 A | 5/1983 |

(Continued)

OTHER PUBLICATIONS

Koos, J., "Long Stroke Ram-Style Tensioner Technology," Offshore Technology Conference, pp. 2 (May 6-9, 2013) (Abstract).

(Continued)

*Primary Examiner* — Matthew R Buck

(74) *Attorney, Agent, or Firm* — Hogan Lovells US LLP

(57) ABSTRACT

Embodiments of the present disclosure include a riser tensioner includes a cylinder barrel, a rod reciprocally carried within the cylinder barrel and having an external end sealingly extending out of a proximal end of the cylinder barrel, and a piston on an interior end of the rod that slides and seals against an inner surface of the cylinder barrel. The tensioner further includes a selectively sealed low pressure chamber in the cylinder barrel between the piston and a distal end of the cylinder barrel and fillable with a low pressure fluid, and a selectively sealed annulus between the rod and the cylinder barrel, the annulus extending between the piston and the proximal end of the cylinder barrel and fillable with an annulus fluid at a pressure higher than the low pressure fluid, thereby urging the piston and rod towards retraction.

20 Claims, 4 Drawing Sheets

(52) U.S. Cl.
CPC ..... *F15B 15/1447* (2013.01); *F15B 15/1461* (2013.01); *F15B 15/16* (2013.01)

(56) References Cited

U.S. PATENT DOCUMENTS

| | | | | |
|---|---|---|---|---|
| 4,638,978 | A | 1/1987 | Jordan | |
| 4,799,827 | A * | 1/1989 | Jaqua | E21B 19/006 166/350 |
| 4,878,546 | A | 11/1989 | Shaw et al. | |
| 5,252,004 | A * | 10/1993 | Butler | E21B 19/09 405/211 |
| 5,846,028 | A | 12/1998 | Thory | |
| 6,968,900 | B2 * | 11/2005 | Williams | E21B 19/09 166/355 |
| 7,112,011 | B2 | 9/2006 | McCarty et al. | |
| 7,131,922 | B2 | 11/2006 | Williams et al. | |
| 7,329,070 | B1 | 2/2008 | Trent et al. | |
| 7,819,195 | B2 * | 10/2010 | Ellis | E21B 19/002 166/352 |
| 7,823,646 | B2 * | 11/2010 | Ellis | E21B 19/002 166/352 |
| 7,934,561 | B2 * | 5/2011 | Ormond | E21B 19/006 114/264 |
| 7,980,787 | B1 * | 7/2011 | Trent | E21B 19/002 166/355 |
| 8,047,122 | B1 | 11/2011 | Trent et al. | |
| 8,286,714 | B2 | 10/2012 | Ellis et al. | |
| 8,496,409 | B2 | 7/2013 | Aksel et al. | |
| 8,789,604 | B2 | 7/2014 | Phadke et al. | |
| 9,353,581 | B2 * | 5/2016 | Megens | E21B 19/006 |
| 9,359,836 | B2 * | 6/2016 | Liland | E21B 19/09 |
| 9,359,837 | B2 * | 6/2016 | Poehner | E21B 19/002 |
| 9,440,829 | B2 * | 9/2016 | Sadiq | B66F 11/00 |
| 2008/0031692 | A1 | 2/2008 | Wybro et al. | |
| 2008/0187401 | A1 | 8/2008 | Bishop et al. | |
| 2014/0202327 | A1 * | 7/2014 | Ellis | E21B 19/006 92/143 |
| 2016/0145951 | A1 * | 5/2016 | Ellis | F15B 1/04 405/224.4 |

FOREIGN PATENT DOCUMENTS

| | | | |
|---|---|---|---|
| GB | 2 512 441 | A | 10/2014 |
| WO | 2013/062735 | A2 | 5/2013 |

OTHER PUBLICATIONS

Wagner et al., Tensioner cylinder with internal gas bladder in high pressure chamber, GE co-pending U.S. Appl. No. 15/253,451, filed Aug. 31, 2016.

Invitation to Pay Additional Fees issued in connection with corresponding PCT Application No. PCT/US2017/020302 dated Jun. 16, 2017.

* cited by examiner

INVERTED PULL-UP RISER TENSIONER

CROSS-REFERENCE TO RELATED CASES

This application is a non-provisional of U.S. Provisional Patent Application No. 62/302,549, filed on Mar. 2, 2016, which is incorporated herein by reference in its entirety.

BACKGROUND

1. Field of the Invention

The invention relates generally to an offshore riser tensioner assembly. More specifically, the invention relates to pull up riser tensioner having a rod with a piston that telescopes within a cylinder, the pull-up force being applied from pressure in an annulus surrounding the rod.

2. Description of Related Art

Risers are used for offshore oil and gas wells to connect the subsea wellhead to the topside equipment on a floating production platform. Typically, a riser system is employed to provide a conduit from a floating vessel at the water surface where the blowout preventer (BOP) stack or production tree is located down to the wellhead at the sea floor.

Tensioners are employed at the platform to apply tension to the risers. A tensioning system maintains a variable tension to the riser string, thereby alleviating the potential for compression, which can lead to buckling or failure of the risers. Another purpose of a tensioner is to serve as a motion compensator. A tensioner that is coupled to riser string can compensate for vessel motion inducted by wave action and heave.

SUMMARY

In an embodiment, a riser tensioner includes a cylinder barrel adapted to be connected to a riser, a rod reciprocally carried within the cylinder barrel and extending out an upper end of the cylinder barrel, the rod having an upper end adapted to be connected to a floating platform, and a flange on a first end of the cylinder barrel, the flange having an opening through which the rod sealingly extends. The tensioner further includes a piston on an interior end of the rod that slides and seals against an inner surface of the cylinder barrel, a low pressure chamber in the cylinder barrel on a lower side of the piston and containing a low pressure fluid, and a sealed annulus between the rod and the cylinder barrel, the annulus extending from an upper side of the piston to the flange and containing a high pressure fluid at a pressure higher than the low pressure fluid to urge the piston downward relative to the cylinder barrel, thereby retracting the riser tensioner and exerting an upward force on the riser.

In another embodiment, a riser tensioner includes a cylinder barrel, a rod reciprocally carried within the cylinder barrel and having an external end sealingly extending out of a proximal end of the cylinder barrel, and a piston on an interior end of the rod that slides and seals against an inner surface of the cylinder barrel. The tensioner further includes a selectively sealed low pressure chamber in the cylinder barrel between the piston and a distal end of the cylinder barrel and fillable with a low pressure fluid, a first high pressure seal extending around the piston in sealing engagement with the inner surface of the cylinder barrel, a low pressure seal extending around the piston in sealing engagement with the inner surface of the cylinder barrel, the low pressure seal closer to the low pressure chamber than the high pressure seal, and a low pressure seal lubricant conduit extending to a point between the high pressure seal and the low pressure seal, the low pressure lubricant conduit at the same pressure as the low pressure chamber. The riser tensioner also includes a selectively sealed annulus between the rod and the cylinder barrel, the annulus extending between the piston and the proximal end of the cylinder barrel and fillable with an annulus fluid at a pressure higher than the low pressure fluid, thereby urging the piston and rod towards the distal end of the cylinder barrel and the riser tensioner towards retraction.

In an embodiment, method of tensioning a riser includes pressurizing a low pressure chamber of a riser tensioner, the low pressure chamber formed between a piston and a distal end of a cylinder barrel, wherein the piston is sealed against an inner surface of the cylinder barrel via a seal and coupled to a rod extending from the piston and beyond of a proximal end of the cylinder barrel. The method further includes pressurizing an annulus of the riser tensioner at a higher pressure than the low pressure chamber, the annulus formed between the rod and the cylinder barrel. The method further includes filling a low pressure seal lubricant conduit at least partially with a low pressure lubricant, the low pressure lubricant conduit extending to a point on a low pressure side of the seal, and filling a high pressure seal lubricant conduit at least partially with a high pressure lubricant, the high pressure lubricant conduit extending to a point on a high pressure side of the seal.

BRIEF DESCRIPTION OF DRAWINGS

The foregoing aspects, features, and advantages of the present disclosure will be further appreciated when considered with reference to the following description of embodiments and accompanying drawings. In describing the embodiments of the disclosure illustrated in the appended drawings, specific terminology will be used for the sake of clarity. However, the disclosure is not intended to be limited to the specific terms used, and it is to be understood that each specific term includes equivalents that operate in a similar manner to accomplish a similar purpose.

DETAILED DESCRIPTION

The foregoing aspects, features, and advantages of the present disclosure will be further appreciated when considered with reference to the following description of embodiments and accompanying drawings. In describing the embodiments of the disclosure illustrated in the appended drawings, specific terminology will be used for the sake of clarity. However, the disclosure is not intended to be limited to the specific terms used, and it is to be understood that each specific term includes equivalents that operate in a similar manner to accomplish a similar purpose.

When introducing elements of various embodiments of the present disclosure, the articles "a", "an", "the", and "said" are intended to mean that there are one or more of the elements. The terms "comprising", "including", and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments", or "other embodiments" of the present disclosure are not intended to be interpreted as excluding the existence of additional embodiments that also incorporate the recited features. Furthermore, reference to terms such as "above", "below", "upper", "lower", "side", "front", "back", or other terms regarding orientation or direction are made with reference to the illustrated embodiments and are not intended to be limiting or exclude other orientations or directions.

Embodiments of the present disclosure include an inverted pull-up riser tensioner that utilizes an internal accumulator to maintain a pressure differential within the riser tensioner to retract the riser tensioner and pull a riser upward.

Figure 1:
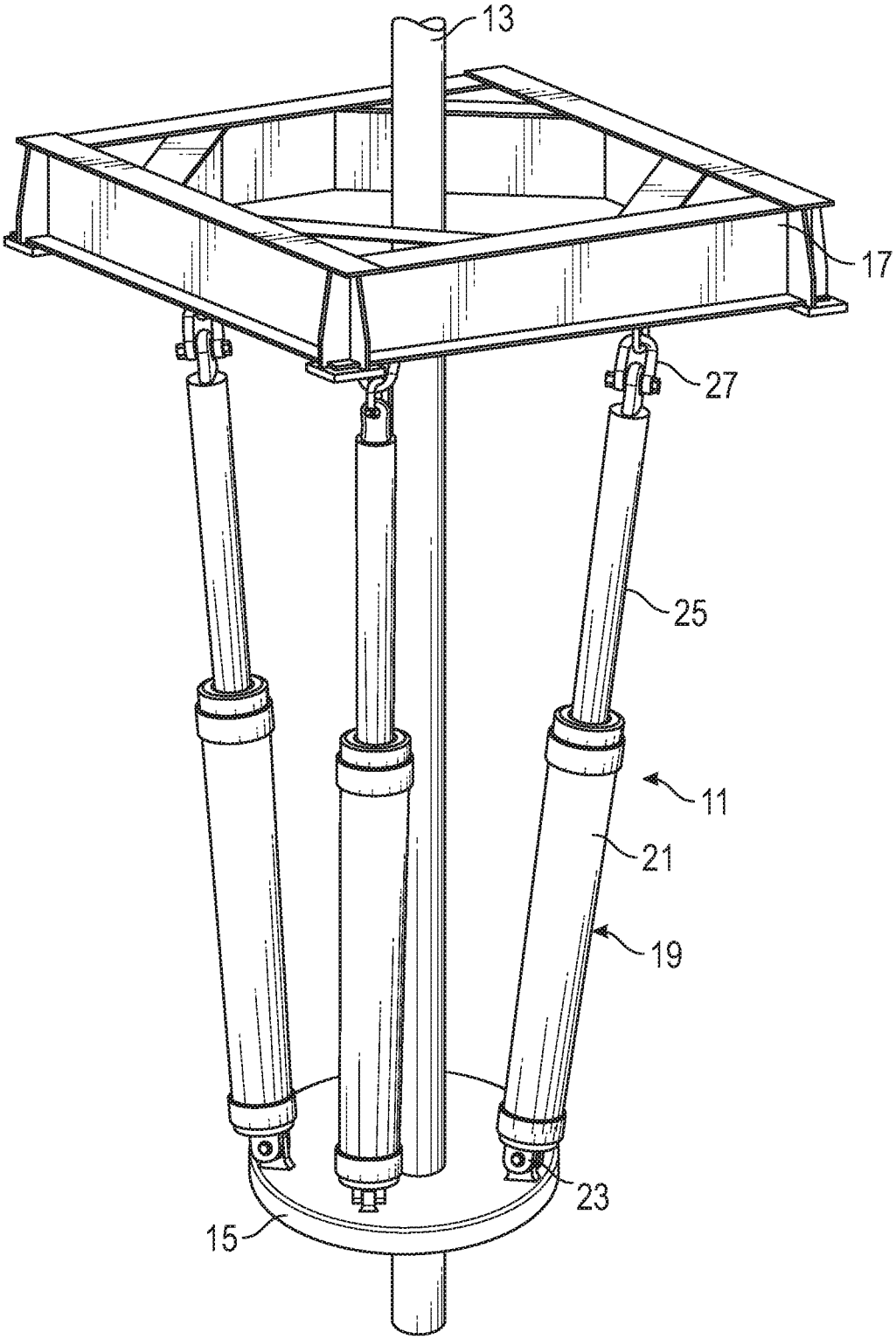
FIG. 1 is a perspective view of a riser tensioner constructed in accordance with this disclosure.

FIG. 1 illustrates a riser tensioner assembly 11 for applying tension to an offshore riser 13. Riser 13 extends from production or drilling equipment (not shown) on the sea floor to a floating production platform. A tension ring 15 rigidly secures to riser 13, which extends upward from tension ring 15 through a frame 17 on the production platform. A number of tensioner cylinders 19 extend between tension ring 15 and frame 17. Tensioner cylinders 19 are spaced around riser 13. Each tensioner cylinder 19 has a cylinder barrel 21, which in this embodiment has a lower end secured by a clevis 23 or alternative interface mechanism to tension ring 15. Each tensioner cylinder 19 has a rod 25 that extends from cylinder barrel 21. In this example, rod 25 extends upward from cylinder barrel 21 and connects to frame 17, such as with a shackle 27 or alternative interface mechanism. In this embodiment, tensioner cylinders 19 tilt outward from clevis 23 to shackle 27. Gas pressure in each tensioner cylinder 19 urges rod 25 to a retracted position to apply tension to riser 13. As the platform moves in response to waves and current, cylinder barrel 21 and rod 25 of each tensioner cylinder 19 retract and extend in a telescoping manner.

Figure 2:
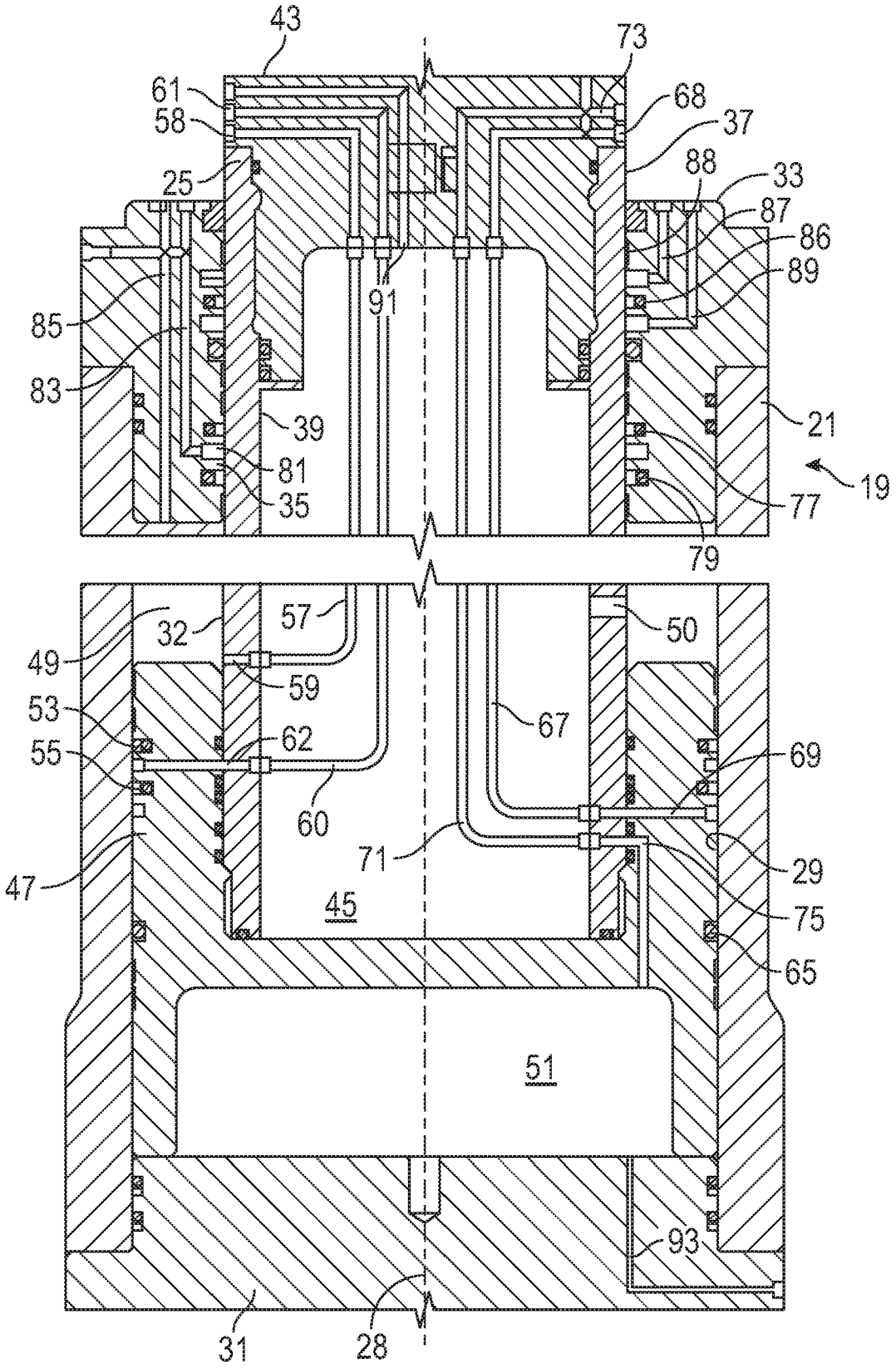
FIG. 2 is an enlarged sectional view of part of one of the tensioner cylinders and rod of the riser tensioner of FIG. 1.

FIG. 2 shows a sectional view of an upper and lower portion of one of the tensioner cylinders 19 in a retracted position and with the central portion not shown. Cylinder barrel 21 has an axis 28 and an inner diameter surface 29 that is closed on a lower end by a barrel lower end cap 31 secured to cylinder barrel 21. A cylinder head or flange 33 secures to the upper end of cylinder barrel 21. Flange 33 has a central opening 35 through which rod 25 sealingly extends.

Rod 25 has an outer diameter surface 37 that slides and seals against flange opening 35. Rod 25 is a sleeve or tubular member, having a hollow interior defined by an inner diameter surface 39. A rod upper end cap 43 secures to the upper end of rod 25, as by threads. Rod 25 has an internal accumulator or rod chamber 45 within rod 25 that contains a pressurized gas, such as nitrogen.

Rod 25 has a piston 47 secured to its lower end. Piston 47 secures by threads or the like to rod external surface 37 and sealingly engages barrel inner diameter surface 29. Piston 47 closes the bottom of rod chamber 45. Piston 47 and flange 33 define a sealed annulus 49 between them. Rod outer surface 37 defines the inner diameter of annulus 49, and cylinder barrel inner diameter surface 29 defines the outer diameter of annulus 49. Annulus 49 communicates with rod chamber 45 via a port 50 through the sidewall of rod 25. Annulus 49 contains a pressurized gas that is at the same gas pressure as in rod chamber 45.

Piston 47 separates a low pressure chamber 51 in cylinder barrel 21 from annulus 49 and rod chamber 45. Low pressure chamber 51 contains a pressurized gas and optionally is sealed from the exterior. The gas pressure in rod chamber 45 and annulus 49 is higher than in low pressure chamber 51 to urge rod 25 toward a retracted position. The gas pressure in annulus 49 acts on the upper side of piston 41 to urge it downward, while gas within rod chamber 45 serves as an accumulator for annulus 49.

The volume of annulus 49 decreases as rod 25 extends, and the volume of low pressure chamber 51 proportionately increases. The volume of rod chamber 45 is fixed and remains the same as rod 25 strokes. In one embodiment, the pressure in rod chamber 45 and annulus 49 increases from about 1000 to 2800 psi when rod 25 moves from full retraction to full extension. In the same embodiment, the pressure in low pressure chamber 51 decreases from about 150 to 10 psi when rod 25 moves from full retraction to full extension. In this example, there are no external chambers or accumulators for rod chamber 45, annulus 49 and low pressure chamber 51, but there could be. Rod chamber 45, annulus 49 or low pressure chamber 51 are sealed once charged with the desired gas pressures, and remain sealed during operation.

In this embodiment, piston 47 has two high pressure seals 53, 55 extending around it that slide and seal against cylinder barrel inner diameter surface 29. High pressure piston seals 53, 55 seal the gas in annulus 49 from the gas in low pressure chamber 51. Generally, providing high pressure seals 53, 55 with a liquid lubricant improves reliability and increases the life. The liquid lubricant may be a variety of types, including glycol and water or vegetable oil, for example. In this embodiment, the liquid lubricant does not disperse uniformly throughout the gas in rod chamber 45, annulus 49 or low pressure chamber 51.

A high pressure lubricant conduit or tube 57 extends downward within rod chamber 45 from a high pressure lubricant passage 58 in rod upper end cap 43. High pressure lubricant tube 57 may be approximately ⅛ inch to ¼ inch in inner diameter, for example, and is much smaller in cross-sectional area than rod chamber 45, thereby having a negligible impact on the internal gas volume of chamber 45. The lower end of high pressure lubricant tube 57 extends to a rod high pressure lubricant port 59 extending radially through the sidewall of rod 25. Rod high pressure lubricant port 59 extends into the lower end of annulus 49 and is in fluid communication with the gas in annulus 49. High pressure lubricant port 59 enters annulus 49 just above the upper end of piston 47.

Another high pressure lubricant tube 60 extends downward within rod chamber 45 from a high pressure lubricant passage 61 in rod upper end cap 43. The lower end of high pressure lubricant tube 60 extends to a port 62 leading through the sidewall of rod 25 and piston 47. High pressure lubricant port 62 extends to the an annular groove on the exterior of piston 47 between high pressure seals 53, 55.

High pressure lubricant tubes 57, 60 supply a liquid lubricant to piston high pressure ports 59 and 62 to lubricate high pressure seals 53, 55. A pool of the liquid lubricant will be located on the upper end of piston 47. Liquid lubricant will also be present in the annular groove between high pressure seals 53, 55. The pressure of lubricant in high pressure tube 57 will be the same as the pressure in annulus 49 and rod chamber 45. The pressure of lubricant in high pressure tube 60 may initially be much lower than the gas pressure within annulus 49. If seal 53 leaks, fluid pressure in port 62 and tube 60 will increase until equal to the gas pressure in annulus 49. Thus, if the pressure in port 62 is found to be increasing, that is an indication that seal 53 may be leaking. In this embodiment, technicians close the upper ends of high pressure lubricant passages 58, 61 once tubes 57, 60 are filled with lubricant. During operation, there is no external accumulator that continuously supplies lubricant to high pressure lubricant tubes 57, 60, but there could be. The volumes of lubricant tubes 57, 60 serve as reservoirs for high pressure lubricant.

Another seal, referred to herein as a piston low pressure seal 65, extends around piston 47 below high pressure seals 53, 55. Low pressure seal 65 slides and seals against cylinder barrel inner diameter surface 29 to prevent the lubricant between seal 55 and 65 from leaking down into chamber 51. Thus. seal 65 has liquid above and gas below. Since seal 55 may be sealing high pressure, fluid is kept on both sides of seal 55.

A low pressure lubricant tube 67, similar to high pressure lubricant tube 57, has an upper end that connects to a low pressure lubricant passage 68 in rod upper end cap 43. Low pressure lubricant tube 67 extends downward in rod chamber 45 and may be parallel with high pressure lubricant tubes 57, 60 and axis 28. The lower end of low pressure lubricant tube 67 secures to a low pressure lubricant port 69 that extends through the sidewall of rod 25 and piston 47 to an annular groove on the exterior of piston 47. Low pressure lubricant port 69 extends to a point below high pressure seal 55 and above low pressure seal 65, and maintains a balanced fluid pressure across seal 65.

A low pressure communication tube 71 has an upper end that connects to a low pressure communication passage 73 in rod upper end cap 43. Low pressure communication tube 71 extends downward in rod chamber 45 and may be parallel with lubricant tubes 57, 60 and 67. Low pressure communication passage 73 joins low pressure lubricant passage 68. The lower end of low pressure communication tube 71 connects to a communication port 75 extending through the sidewall of rod 25 and downward in piston 47 to low pressure chamber 51. Low pressure communication tube 71 does not contain lubricant; rather it applies the pressure of low pressure chamber 51 to the upper end of low pressure lubricant passage 68 to equalize pressure across low pressure seal 65.

Low pressure lubricant tube 67 supplies a liquid lubricant to lubricate piston low pressure seal 65. The low pressure lubricant may be the same type as the high pressure lubricant or it may differ. The pressure of lubricant in low pressure tube 67 is less than the pressure in high pressure tube 57. The pressure of lubricant in low pressure tube 67 will be the same as the pressure in low pressure chamber 51, which varies between extension and retraction. In this embodiment, technicians close the upper end of low pressure lubricant tube 67 once filled with lubricant. During operation of this embodiment, there is no external accumulator that continuously supplies lubricant to low pressure lubricant tube 67, but there could be. The volume of low pressure lubricant tube 67 serves as a reservoir for low pressure lubricant.

Flange 33 has flange high pressure seals 77, 79 in its opening 35 that dynamically seal to rod outer surface 37 as rod 25 retracts and extends. In this embodiment, flange opening 35 has an annular high pressure annular lubricant groove 81 between high pressure seals 77, 79. A high pressure lubricant port 83 extends downward from the upper side of flange 33 to annular groove 81. The upper end of high pressure port 83 will then be plugged or otherwise closed off after filling. A high pressure communication passage 85 extends from annulus 49 through flange 33. The upper end of high pressure communication passage 85 joins the upper end of high pressure lubricant passage 83 to apply gas pressure to the lubricant in annular groove 81 that is the same as the pressure in annulus 49. High pressure communication passage 85 equalizes the pressure across high pressure seal 79.

An additional seal 86 and wear band 88 may be mounted to flange opening 35 above flange high pressure seals 77, 79 for sealing engagement with rod outer surface 37. A lubricant passage 87 in flange 33 supplies liquid lubricant to an annular groove between seal 86, and wear band 88. A lubricant passage 89 supplies liquid lubricant to an annular groove below seal 86 and above seal 77. The lubricant supplied to passages 87, 89 is at a pressure that is normally lower than in high pressure lubricant passage 83, unless leakage occurs from seals 77, 79 below.

A high pressure gas port 91 extends from the outer surface of rod upper end cap 43 to rod chamber 49. Technicians use high pressure gas port 91 to pressurize the gas in annulus 49 and rod chamber 45, then close off high pressure gas port 91. A low pressure gas port 93 extends through barrel end cap 31 to fill and close off low pressure chamber 51. Alternately, passages 73, 75 and tube 71 could be used to fill low pressure gas in low pressure chamber 51.

Figure 3:
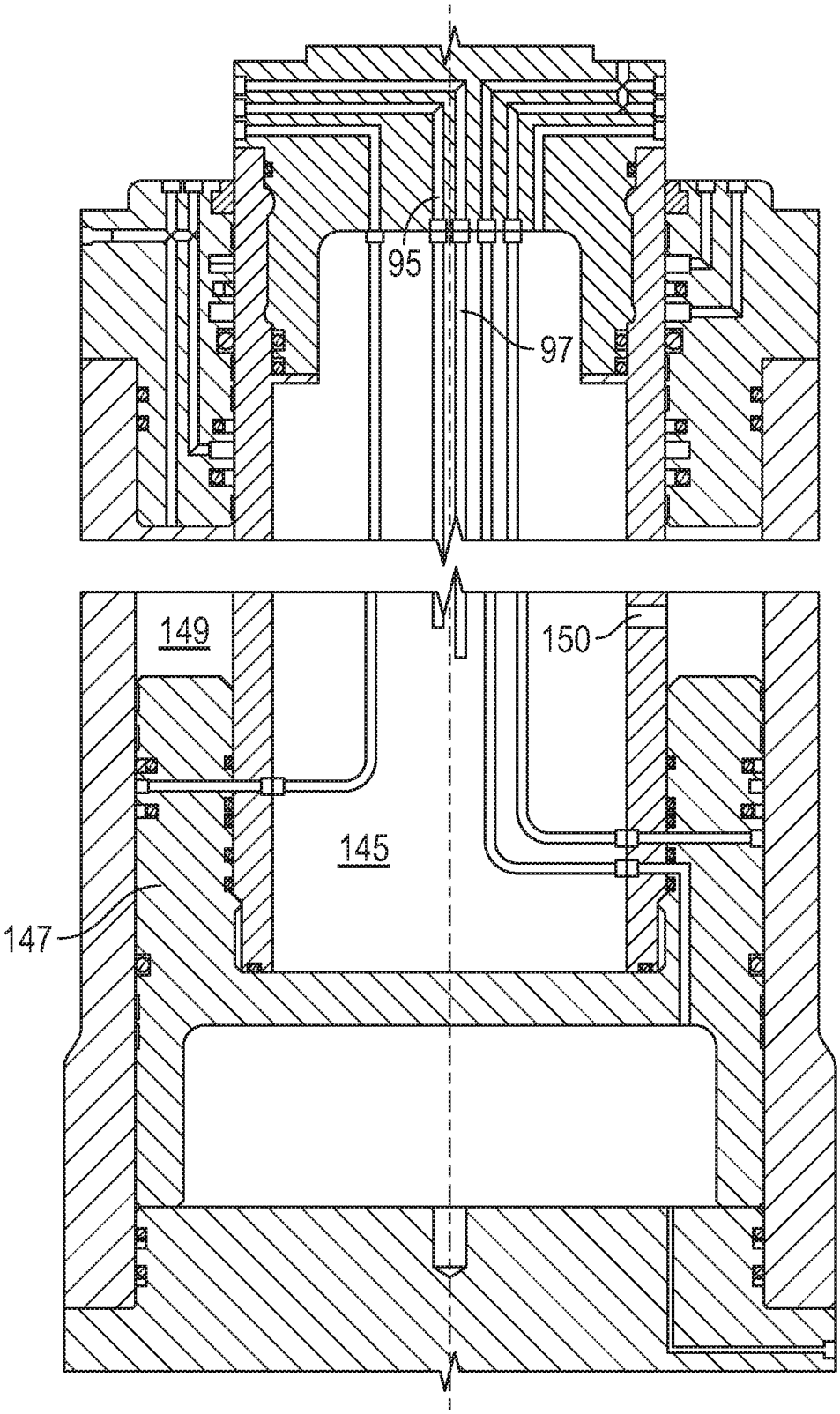
FIG. 3 is a sectional view of a second embodiment of a riser tensioner constructed in accordance with this disclosure.
Figure 4:
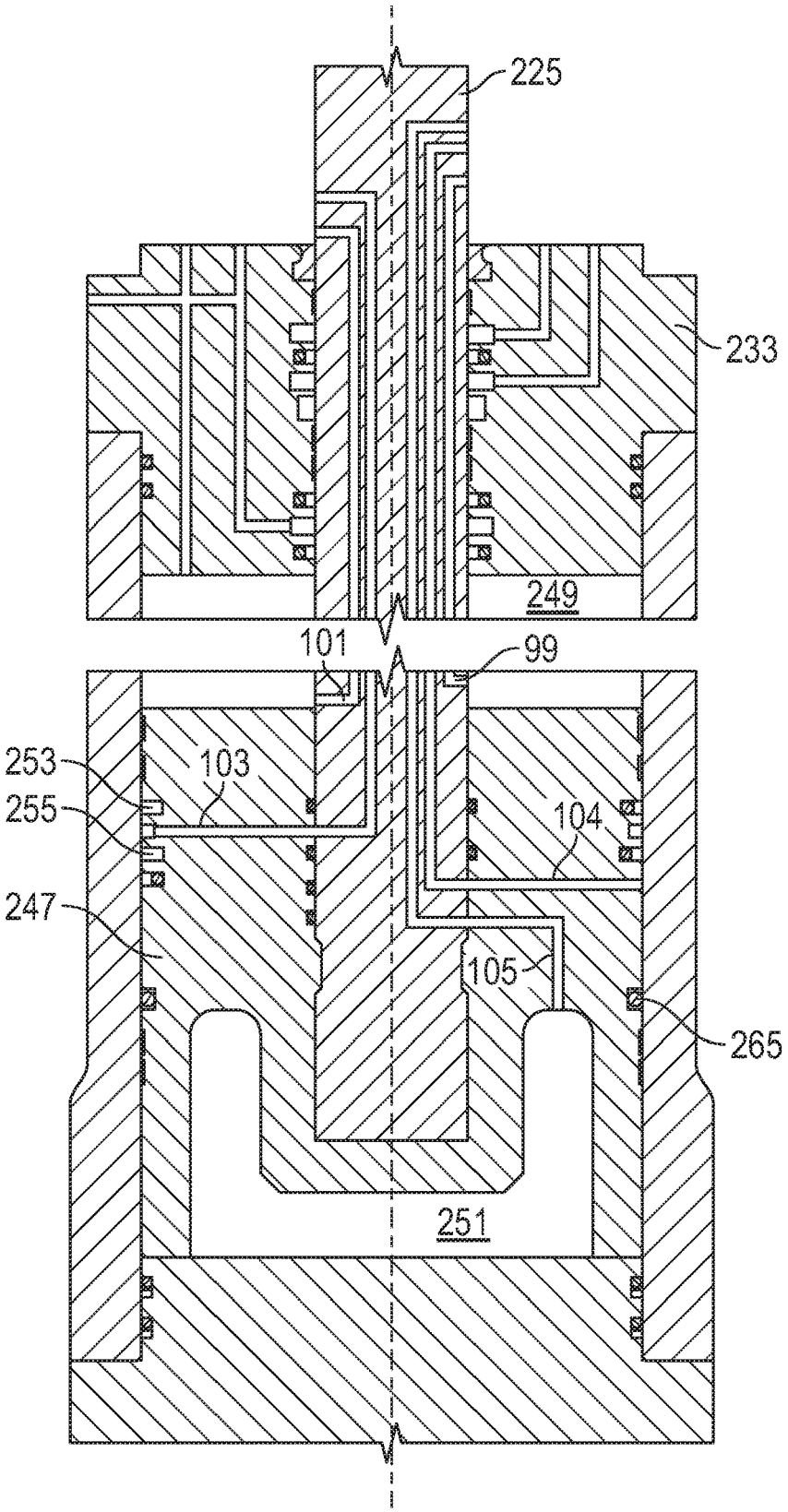
FIG. 4 is a sectional view of a third embodiment of a riser tensioner constructed in accordance with this disclosure.

FIGS. 3 and 4 illustrate alternate embodiments. Many of the components that are similar to the first embodiment will not be discussed. Referring to FIG. 3, a high pressure lubricant tube 95 has a lower end that terminates in rod chamber 145, rather than annulus 149. Another high pressure lubricant tube 97 extends into rod chamber 145 and terminates at a lower point than high pressure lubricant tube 95. The lower end of high pressure lubricant tube 97 is at the same level as or higher than communication port 150. The lower end of high pressure lubricant tube 95 is above high pressure lubricant tube 97. High pressure liquid lubricant will be dispensed into rod chamber 145 through the longer tube 97 and will fill the lower portion of rod chamber 145 to a level above communication port 150. Some of the high pressure liquid lubricant will flow through communication port 150 to the upper side of piston 147. Technicians can check when lubricant flows out the shorter tube 95 while under pressure to determine that the high pressure liquid lubricant level is at least that high.

Referring to FIG. 4, rod 225 is solid and does not have a rod chamber like rod chambers 45 and 145. Instead, an accumulator port 99 leads from annulus 249 upward through rod 225 to the exterior of rod 225 above flange 233. Rather than high and low pressure liquid lubricant tubes, as in the other embodiments, passages within rod 225 are used, each leading to the upper end of rod 225. These passages include a high pressure lubricant passage 101 that supplies high pressure liquid lubricant to the lower end of annulus 249. A high pressure lubricant passage 103 supplies high pressure liquid lubricant to an annular groove on the exterior of piston 247 between piston high pressure seals 253 and 255.

A low pressure lubricant passage 104 supplies lower pressure liquid lubricant to an annular groove on the exterior of piston 247 between piston high pressure seal 255 and piston low pressure seal 265. A low pressure communication passage 105 extends down rod and piston 247 to low pressure chamber 251. An upper end of low pressure communication passage 105 joins an upper end of low pressure lubricant passage 104 to equalize pressure across piston low pressure seal 265.

The present invention described herein, therefore, is well adapted to carry out the objects and attain the ends and advantages mentioned, as well as others inherent therein.

While certain embodiments of the invention have been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims. The foregoing disclosure and description of the disclosed embodiments is illustrative and explanatory of the embodiments of the invention. Various changes in the details of the illustrated embodiments can be made within the scope of the appended claims without departing from the true spirit of the disclosure. The embodiments of the present disclosure should only be limited by the following claims and their legal equivalents.

The invention claimed is:

1. A riser tensioner, comprising:

a cylinder barrel adapted to be connected to a riser;

a rod reciprocally carried within the cylinder barrel and extending out an upper end of the cylinder barrel, the rod having an upper end adapted to be connected to a floating platform;

a flange on the upper end of the cylinder barrel, the flange having an opening through which the rod sealingly extends;

a piston on a lower end of the rod that slides and seals against an inner surface of the cylinder barrel;

a low pressure chamber in the cylinder barrel on a lower side of the piston and containing a low pressure fluid; and a sealed annulus between the rod and the cylinder barrel, the annulus extending from an upper side of the piston to the flange and containing a high pressure fluid and a seal lubricant, both introduced into the sealed annulus via independent flow paths, both at a pressure higher than the low pressure fluid to urge the piston downward relative to the cylinder barrel, thereby retracting the riser tensioner and exerting an upward force on the riser.

2. The riser tensioner of claim 1, further comprising:

at least two piston high pressure seals extending around the piston in sealing engagement with the inner surface of the cylinder barrel to seal one end of the annulus;

a high pressure seal lubricant conduit extending within the rod to a point between the piston high pressure seals; and a high pressure seal lubricant within the high pressure seal lubrication conduit at a pressure that is the same as the fluid pressure in the annulus.

3. The riser tensioner of claim 2, further comprising:

a piston low pressure seal extending around the piston below the piston high pressure seals;

a low pressure lubricant conduit extending within the rod to a point below the piston high pressure seals and above the piston low pressure seal; and a low pressure lubricant within the low pressure lubricant conduit that is at a same pressure as the fluid pressure in the low pressure chamber.

4. The riser tensioner of claim 2, further comprising:

a high pressure annulus lubricant conduit extending within the rod to the annulus; and the seal lubricant within the high pressure annulus lubricant conduit at a pressure that is the same as the fluid pressure in the annulus.

5. The riser tensioner of claim 1, wherein the rod has a hollow interior that defines a rod chamber, the rod chamber containing a high pressure accumulator fluid in fluid communication with and at the same pressure as the high pressure fluid in the annulus.

6. The riser tensioner of claim 2, wherein:

the rod is solid; and the high pressure seal lubricant conduit comprises a passage extending downward in the rod.

7. A riser tensioner, comprising:

a cylinder barrel;

a rod reciprocally carried within the cylinder barrel and having an external end sealingly extending out of a proximal end of the cylinder barrel;

a piston on an interior end of the rod that slides and seals against an inner surface of the cylinder barrel;

a selectively sealed low pressure chamber in the cylinder barrel between the piston and a distal end of the cylinder barrel and fillable with a low pressure fluid;

a first high pressure seal extending around the piston in sealing engagement with the inner surface of the cylinder barrel;

a low pressure seal extending around the piston in sealing engagement with the inner surface of the cylinder barrel, the low pressure seal closer to the low pressure chamber than the high pressure seal;

a low pressure seal lubricant conduit extending to a point between the high pressure seal and the low pressure seal and fillable with a low pressure lubricant at approximately the same pressure as the low pressure chamber; and a selectively sealed annulus between the rod and the cylinder barrel, the annulus extending between the piston and the proximal end of the cylinder barrel and fillable with an annulus fluid at a pressure higher than the low pressure fluid, thereby urging the piston and rod towards the distal end of the cylinder barrel and the riser tensioner towards retraction.

8. The riser tensioner of claim 7, further comprising:

a second high pressure seal extending around the piston in sealing engagement with the inner surface of the cylinder barrel, the second high pressure seal located on a side of the first high pressure seal opposite the low pressure seal.

9. The riser tensioner of claim 8, further comprising:

a high pressure seal lubricant conduit extending to a point between the first high pressure seal and the second high pressure seal and fillable with a high pressure lubricant at the same pressure as the annulus fluid.

10. The riser tensioner of claim 7, further comprising a high pressure annulus lubricant conduit extending to the annulus and fillable with an annulus lubricant at the same pressure as the annulus fluid.

11. The riser tensioner of claim 7, further comprising a low pressure communication conduit extending to the low pressure chamber and in communication with the low pressure seal lubricant conduit, equalizing pressure between the low pressure chamber and the low pressure seal lubricant conduit.

12. The riser tensioner of claim 7, wherein the external end of the rod is couplable with a floating platform and the distal end of the cylinder barrel is couplable with a riser or riser tension ring.

13. The riser tensioner of claim 7, further comprising a high pressure chamber within the rod and fillable with a high pressure fluid at the same pressure as the annulus fluid.

14. The riser tensioner of claim 13, further comprising a communication port formed in the rod placing the high pressure chamber in fluid communication with the annulus.

15. The riser tensioner of claim 13, further comprising a high pressure lubricant conduit extending to the high pressure chamber through which a high pressure lubricant is deliverable.

16. A method of tensioning a riser, comprising pressurizing a low pressure chamber of a riser tensioner, the low pressure chamber formed between a piston and a distal end of a cylinder barrel, wherein the piston is sealed against an inner surface of the cylinder barrel via a seal and coupled to a rod extending from the piston and beyond a proximal end of the cylinder barrel, and wherein the cylinder barrel is adapted to connect to a riser and the rod is adapted to connect to a floating platform;

pressurizing an annulus of the riser tensioner at a higher pressure than the low pressure chamber, the annulus of the riser tensioner formed between the rod and the cylinder barrel and extending between the piston and the proximal end of the cylinder barrel;

filling a low pressure seal lubricant conduit at least partially with a low pressure lubricant, the low pressure lubricant conduit extending to a point on a low pressure side of the seal; and filling a high pressure seal lubricant conduit at least partially with a high pressure lubricant, the high pressure lubricant conduit extending to a point on a high pressure side of the seal.

17. The method of claim 16, further comprising sealing any or all of the low pressure chamber, the annulus, the low pressure seal lubricant conduit, and the high pressure seal lubricant conduit.

18. The method of claim 16, further comprising removing any external pressure or lubricant sources from the riser tensioner.

19. The method of claim 16, further comprising maintaining a pressure differential between the annulus and the low pressure chamber via an internal accumulator formed within the rod, the accumulator comprising a high pressure chamber at the same pressure as the annulus.

20. The method of claim 16, further comprising urging retraction of the riser tensioner via a pressure differential between the annulus and the low pressure chamber.

* * * * *